United States Patent [19]

Ruf et al.

[11] 4,107,574

[45] Aug. 15, 1978

[54] TRAVELLING-WAVE TUBE WITH COLLECTOR HOUSING HAVING ALL ELECTRICAL CONNECTIONS THROUGH ONE END WALL OF HOUSING

[75] Inventors: Herbert Ruf, Temmenhausen; Dieter Deml, Ay-Senden; Werner Schwarz, Erbach, all of Germany

[73] Assignee: Licentia Patent-Verwaltungs-G.m.b.H., Frankfurt am Main, Germany

[21] Appl. No.: 694,222

[22] Filed: Jun. 9, 1976

[30] Foreign Application Priority Data

Jun. 14, 1975 [DE] Fed. Rep. of Germany ..... 2526681

[51] Int. Cl.[2] ..... H01J 25/34

[52] U.S. Cl. ..... 315/3.5; 315/3.6; 315/5.38

[58] Field of Search ..... 315/3.5, 3.6, 39.3, 315/5.38

[56] References Cited

U.S. PATENT DOCUMENTS

| | | | |
|---|---|---|---|
| 3,368,104 | 2/1968 | McCullough | 315/5.38 |
| 3,644,778 | 2/1972 | Mihran et al. | 315/5.38 |
| 3,702,951 | 11/1972 | Kosmahl | 315/5.38 |
| 3,824,425 | 7/1974 | Rawls, Jr. | 315/5.38 |
| 3,925,701 | 12/1975 | Wolfram | 315/5.38 |
| 3,993,925 | 11/1976 | Achter et al. | 315/5.38 |

*Primary Examiner*—Saxfield Chatmon, Jr.
*Attorney, Agent, or Firm*—Spencer & Kaye

[57] ABSTRACT

A travelling-wave tube comprises a delay line section, an electron collector comprising several electrodes in a cooling chamber, one end wall of which is connected to the delay line section, the several electrodes being individually mounted on an inner wall of the cooling chamber by insulation with good heat conduction characteristics and individually electrically connected to insulated bushings in the said end wall.

16 Claims, 1 Drawing Figure

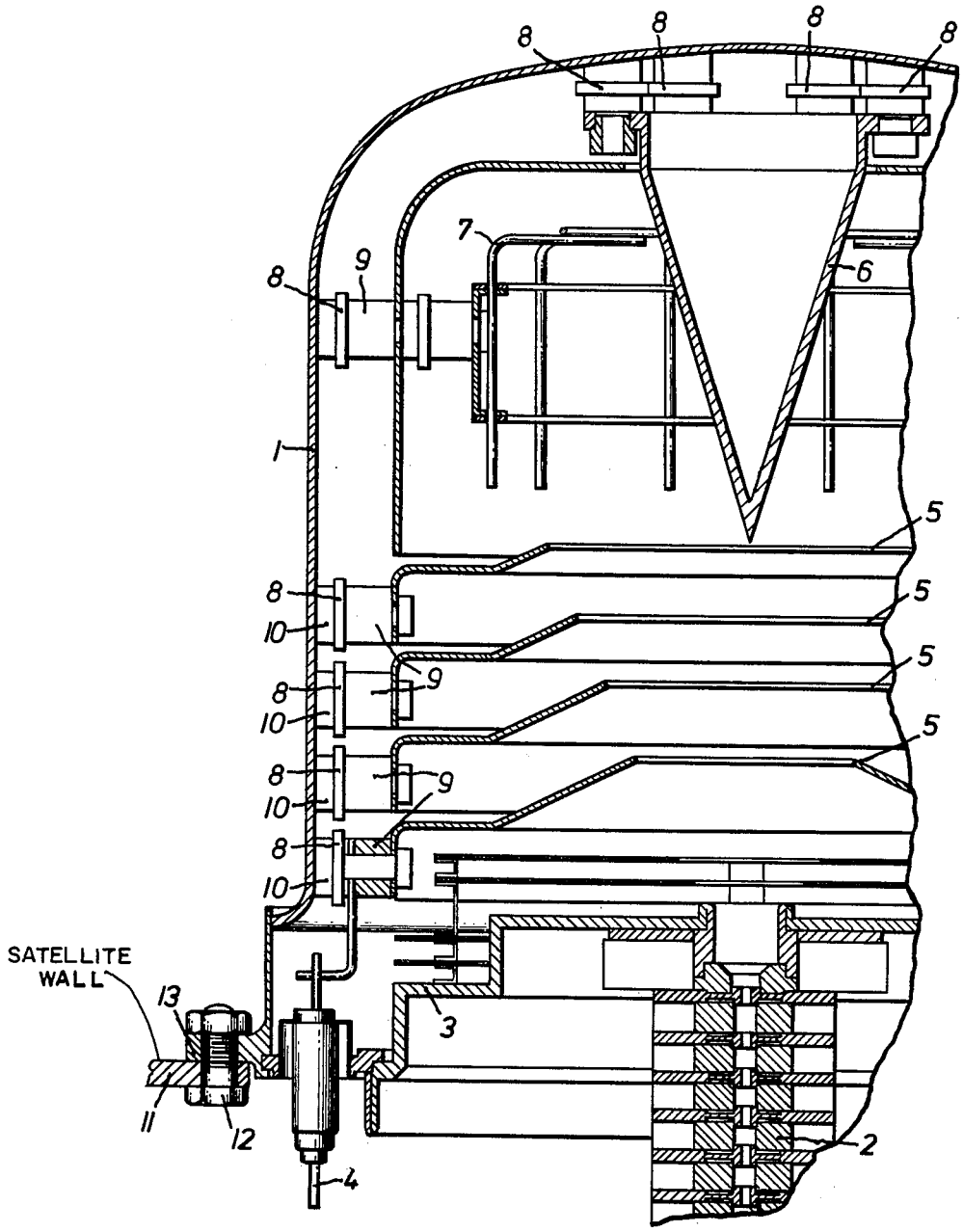
8
8
8
8
7
9
8
6
1
5
8
5
10
9
5
8
10
5
8
9
10
8
10
SATELLITE WALL
13
3
11
12
2
4

TRAVELLING-WAVE TUBE WITH COLLECTOR HOUSING HAVING ALL ELECTRICAL CONNECTIONS THROUGH ONE END WALL OF HOUSING

BACKGROUND OF THE INVENTION

The present invention relates to a travelling-wave tube with a delay line section and an electron collector, comprising several electrodes, which is arranged inside a hollow cylindrical metal cooling chamber having one end surface or wall which is connected in vacuum-tight manner to the end of the delay line section and which has a diameter which is larger than the diameter of the delay line section.

Multi-stage collectors, i.e. electron collectors having several collector electrodes lying one behind the other in the direction of electron beam in order to achieve an improved degree of efficiency, are already known in travelling-wave tubes.

SUMMARY OF THE INVENTION

It is an object of the invention to provide a new type of travelling-wave tube the collector of which permits an improved heat dissipation.

A further object of the invention is to so form the collector of a travelling-wave tube that sufficient cooling, particularly when installing such a travelling-wave tube in a satellite, is ensured.

According to a first aspect of the invention, there is provided a travelling-wave tube comprising a delay line section, an electron collector, several electrodes forming said electron collector, a cooling chamber in which said several electrodes are located, an end wall for said cooling chamber connected to said delay line section, a plurality of electrical insulators with good heat conduction characteristics mounted on an inner wall of said cooling chamber for mounting individual ones of said several electrodes, insulated bushings in said end wall of said cooling chamber, and means electrically connecting said insulated bushings to individual ones of said several electrodes.

According to a second aspect of the invention, there is provided a travelling-wave tube having a delay line section and an electron collector comprising several electrodes arranged inside a hollow cylindrical metal cooling chamber, one end wall of which is annular, is connected to the end of said delay line section so as to be vacuum-tight and has a diameter which is greater than the diameter of said delay line section, characterized in that a plurality of electrical insulators which are good conductors of heat are fastened to the inner surface of the wall of said cooling chamber, said individual collector electrodes are mounted on the insulators so as to be good conductors of heat to, while being electrically insulated from, said cooling chamber, insulated bushings are provided on a portion of the annular surface of said end wall, which delay line section said extends laterally beyond said delay line section, and the bushings are connected to said individual collector electrodes in an electrically conductive manner.

BRIEF DESCRIPTION OF THE DRAWING

The invention will now be described in greater detail, by way of example, with reference to the drawing, the single FIGURE of which shows, in cross section, part of an electron collector of a satellite travelling-wave tube.

DESCRIPTION OF THE PREFERRED EMBODIMENTS

In a preferred embodiment of the invention, it is proposed, in a travelling-wave tube as described at the outset, to fasten a plurality of insulators having good thermal conductivity to the inner surface of the wall of the cooling chamber with the individual collector electrodes being mounted on the insulators so as to be good conductors of heat to, while being electrically insulated from, the cooling chamber and to provide insulated bushings on the annular surface of the end wall connected to the delay line section, said annular surface overlapping the delay line section. These bushings are electrically connected to the individual collector electrodes.

The invention is described in greater detail below by means of an example of embodiment shown in the FIGURE.

Referring now to the drawing, there is shown, in cross-section, a part of the electron collector of a satellite travelling-wave tube which is attached to a delay line section 2. Only part of the delay line attached to the electron collector is shown. This delay line is continued and on the other part of this line there is located, in known manner, a system for producing an electron beam. With the aid of magnetic focusing means, the electron beam in the delay line is focused in known manner on its path to the electron beam producing system. The electron collector, the remaining part of the delay line and the focusing means are not shown in the FIGURE for the sake of simplicity. The construction of the tube is preferably rotationally symmetrical about the longitudinal axis of the electron beam.

The electron beam, not shown, and escaping from the delay line section 2 as a beam enters the collector electrode and is absorbed there, wherein the energy of the electron is passed on in the form of heat to the individual electrodes 5, 6 and 7 of the electron collector catcher. Four annular electrodes 5, and a cup-shaped electrode 7 into which an expanding mandrel 6 projects with its tip counter to the electron beam are provided. The expanding mandrel 6 may be at the same potential as the electrode 7 or it may be insulated from the electrode 7 and have a separate potential which causes a further spreading of the remaining electron beam which has not been absorbed by the electrodes 5. The electrodes 5 and 7 are preferably at varying potentials and are separately mounted within the electron collector chamber 1, which forms the cooling chamber at the same time.

The cooling chamber 1 is preferably cup-shaped and is connected vacuum-tight to the delay line section 2 via an end wall 3. The end wall 3 is constructed approximately in plate form, and is provided with a number annular steps. In the preferred embodiment, this end wall 3 serves on the one hand as a mounting for the entire travelling-wave tube and on the other hand as a socket in which the insulated bushings 4 are arranged distributed over the circumference. The diameter of this end wall 3 is substantially larger than the diameter of the delay line section 2. The end wall 3 preferably comprises a turned metallic member of increased stability.

The mounting of the individual collector electrodes 5, 6 and 7 takes place by means of the interposition of insulators 8, which are preferably disc-shaped. Aluminium oxide ceramics have proved to be a suitable material for these insulators. In order to increase the heat conductivity, it may occasionally be advisable to produce these insulators from beryllium oxide. The mounting of the electrodes 5, 6 and 7 takes place preferably on the inner wall of the cooling chamber 1 while interposing the insulating ceramics discs 8. In order to achieve good heat transfer, it is advisable to ensure large-area soldering to the insulators 8.

It has proved to be advisable to provide good heat-conductive intermediate elements 9 at least between the electrodes and the insulators 8, which intermediate elements 9 preferably comprise copper and are constructed so that they may be deformed under varying expansion conditions of the electrodes and of the cooling chamber 1. These intermediate members 9 consist, for example of copper bands which are bent like brackets.

Furthermore, it may be advisable occasionally to additionally provide such intermediate members which absorb mechanical heat stresses by means of deformation between the insulators 8 and the cooling chamber 1. In the FIGURE, these parts are designated 10. The described mounting of the collector electrodes 5, 6 and 7 ensures on the one hand a mechanically stable mounting of the electrodes and on the other hand ensures that there is good dissipation of heat in a radial direction from the individual electrodes through the cooling chamber 1. For example, eight to twelve of these insulators 8 may be provided per electrode, with these insulators being distributed at a uniform spacing around the circumference of the electrodes. Similarly, the fastening of the expanding mandrel 6 to the floor wall of the cooling chamber 1 may take place via several of these insulators 8.

The individual collector electrodes 5, 6 and 7 are preferably at varying electrical voltages, as already shown. The supply of voltages takes place via several insulated bushings 4 which are arranged on the end wall 3 and which in the interior of the chamber 1, are electrically conductively connected to the appropriate electrodes via wires. If the illustrated four plate-shaped collector electrodes 5 as well as the cup-shaped electrode 7 and the expanding mandrel 6 are to be connected to varying potentials, then in the illustrated embodiment, six electrical bushings 4 distributed over the circumference are provided on the end wall 3.

It is particularly useful to provide the end wall 3 with a fixing or mounting flange 13 on its circumference which makes possible stable mounting of the entire travelling-wave tube on a support structure. As shown in the FIGURE, the travelling-wave tube is inserted into an opening in a wall member 11 of the support structure so that the fastening of the tube is undertaken by means of the flange 13. For this purpose a plurality of screw connections 12 may be provided, for example, distributed over the circumference. By means of appropriate intermediate layers between the flange 13 and the wall member 11 it is possible to produce a pressure-tight connection. Such a pressure-tight connection is preferably of advantage if the travelling-wave tube is built into a satellite. Thus the wall 11 preferably constitutes the envelope wall of the satellite. In this manner the cooling chamber 1 of the travelling-wave tube is located outside of the satellite, while the remaining parts of the travelling-wave tube are located inside the satellite. The attachment of the electrical bushings 4 to the end wall 3 then produces the advantage that these bushings 4, which are inserted, vacuum-tight, into the end wall 3, may be connected, so as to be electrically conductive, to voltage sources without difficulty as regards the inner area of the satellite.

The described construction of the collector of the travelling-wave tube permits the part of the heat to be conducted away by convection by the collector electrodes to be increased, and to permit this heat to be conducted away over a large area of the outer wall of a cooling chamber. The described construction is of particular advantage for travelling-wave tubes which are used in satellites, as it allows fastening of the tube to satellites in such a manner that the cooling chamber of the collector is arranged on the outer side of the satellite and intensive cooling is made possible by means of the coldness of outer space. At the same time, a simple mounting of the tube is made possible either in or on the satellite.

It will be understood that the above description of the present invention is susceptible to various modification changes and adaptations.

What is claimed is:

1. In a travelling-wave tube having a delay line section and an electron collector comprising several electrodes arranged inside a hollow cylindrical metal cooling chamber, one end wall of which is annular, is connected to the end of said delay line section so as to be vacuum-tight and has a diameter which is greater than the diameter of said delay line section; the improvement wherein: a plurality of electrical insulators which are good conductors of heat are fastened to the inner surface of the wall of said cooling chamber, said individual collector electrodes are mounted on said insulators so as to be good conductors of heat to, while being electrically insulated from, said cooling chamber, insulated bushings are provided on a portion of the annular surface of said one end wall which extends laterally beyond said delay line section, said bushings being connected to said individual collector electrodes in an electrically conductive manner, and means on said end wall connected to said delay line section for fastening said travelling-wave tube to a support wall so that said cooling chamber is located substantially on one side of said support wall and said delay line section and said insulated bushings extend through one or several openings in said support wall.

2. A travelling-wave tube as defined in claim 1, wherein said collector electrodes comprise at least one part constructed so as to be in the shape of an annular plate and said electrodes are mounted on said insulators at their circumference.

3. A travelling-wave tube as defined in claim 1 wherein said collector electrodes are fastened on said insulators via elements which are good conductors of heat and are deformable for the purpose of absorbing thermal expansion.

4. A travelling-wave tube as defined in claim 1, wherein said fastening means of said end wall are constructed like a flange and permit pressure-tight connection between said end wall and said support wall.

5. A travelling-wave tube as defined in claim 1, wherein said insulators are fastened on said inner surface of the wall of said cooling chamber via elements having good heat conductivity and which are designed for absorbing thermal expansion.

6. A travelling-wave tube as defined in claim 1, wherein each said collector electrode is mounted on several of said insulators which are distributed over the circumference of said collector electrodes.

7. A travelling-wave tube as defined in claim 1, wherein said end wall is fixed by interposing poor heat conductive material in order to mount the tube on a wall.

8. A travelling-wave tube as defined in claim 1, wherein said end wall comprises poor heat-conductive material.

9. A travelling-wave tube as defined in claim 1, wherein said support wall is the outer wall of a satellite and said tube is fastened to said outer wall of said satellite so that said cooling chamber is located on the outer side of said satellite and said insulated bushings and said delay line section are located inside said satellite.

10. A travelling-wave tube as defined in claim 1, wherein at least some of said electrical insulators are fastened to the cylindrical inner wall of said cooling chamber.

11. A travelling-wave tube as defined in claim 1 wherein at least some of said insulators are fastened to the end wall of said cooling chamber which lies opposite to said end wall connected to said delay line section.

12. A travelling-wave tube as defined in claim 1 wherein said insulators comprise ceramics.

13. A travelling-wave tube as defined in claim 1, wherein said insulators comprise aluminium oxide ceramics.

14. A travelling-wave tube as defined in claim 1, wherein the fastening of said insulators is carried out by means of hard soldering.

15. In a travelling-wave tube including a delay line section, an electron collector including a plurality of electrodes disposed within a hollow metal housing having a cylindrical sidewall and a pair of opposed end walls one of which is annular, has a diameter greater than that of said delay line section and is connected to said delay line section, a plurality of electrical insulators mounted on the inner surface of said side wall, means for mounting individual ones of said electrodes on said insulators, insulated bushings extending through a wall of said housing, and means for electrically connecting said insulated bushings to individual ones of said electrodes; the improvement wherein: said housing forms a cooling chamber for said electrodes; said electrical insulators are formed of a material having good heat conduction characteristics and are mounted on said side wall in good heat conducting relationship; said means for mounting comprises an element, formed of good heat conducting material and shaped so as to be deformable for the purpose of absorbing thermal expansion, interposed between the periphery of the associated said electrode and the associated said insulator; all of said insulated bushings extend through the portion of said one end wall of said housing which extends laterally beyond said delay line section; and means are provided on said one end wall for fastening said travelling-wave tube to a mounting wall so that said housing will be on one side of the mounting wall and said bushings and said delay line section can extend through an opening in the mounting wall to the other side thereof.

16. A travelling-wave tube as defined in claim 15 further comprising a further plurality of said electrical insulators formed of said material and mounted in good heat conducting relationship on the inner surface of the end wall of said pair of opposed end walls which is opposite said one end wall; and wherein said means for mounting mounts at least one of said electrodes on said further plurality of electrical insulators.

* * * * *